US006343845B1

(12) United States Patent
Woodard

(10) Patent No.: US 6,343,845 B1
(45) Date of Patent: Feb. 5, 2002

(54) MULTIPLE BAR SOAP STORAGE DISPENSER

(76) Inventor: Solomon Woodard, 4330 New Castle Cir., Lithonia, GA (US) 30038

( * ) Notice: Subject to any disclaimer, the term of this patent is extended or adjusted under 35 U.S.C. 154(b) by 0 days.

(21) Appl. No.: 09/672,872

(22) Filed: Sep. 29, 2000

(51) Int. Cl.[7] ..... A47F 5/08
(52) U.S. Cl. ..... 312/248; 312/213; 312/328
(58) Field of Search ..... 312/248, 213, 312/327, 328, 229, 117, 123, 129, 130, 136, 127

(56) References Cited

U.S. PATENT DOCUMENTS 1,057,541 A * 4/1913 Gettins ..... 312/248 X
2,801,737 A * 8/1957 Derman ..... 312/328 X
2,808,306 A * 10/1957 Schilling ..... 312/248 X
4,392,630 A * 7/1983 Moontasir ..... 312/229 X
4,630,794 A 12/1986 Ross
D359,867 S 7/1995 Elldrege et al.
5,570,938 A * 11/1996 Butler ..... 312/245 X
5,984,440 A 11/1999 Watson
6,062,416 A * 5/2000 Smillie ..... 220/524

* cited by examiner

*Primary Examiner*—Janet M. Wilkens
(74) *Attorney, Agent, or Firm*—Ronald D. Homburg

(57) ABSTRACT

A wall mounted multiple bar soap storage dispenser allowing for the storage and drainage of multiple soap bars in the bath or shower area in which multiple soap bars are placed in individual pivoting soap compartments accessible by opening the pivoting compartment, removing the bar soap and replacing the bar soap in the container for drainage and drying of the bar soap until its next use.

4 Claims, 3 Drawing Sheets

MULTIPLE BAR SOAP STORAGE DISPENSER

CROSS REFERENCE TO RELATED APPLICATIONS

None

I. BACKGROUND OF THE INVENTION

1. Field of Invention

The invention is a wall mounted multiple bar soap storage dispenser allowing for the storage and drainage of multiple soap bars in the bath or shower area in which multiple soap bars are placed in individual pivoting soap compartments accessible by opening the pivoting compartment, removing the bar soap and replacing the bar soap in the container for drainage and drying of the bar soap until its next use.

2. Description of Prior Art

The following United States patents are disclosed herein and incorporated into this application for utility patent. All relate to soap dispensers and containers. U.S. Pat. No. 5,984,440 to Watson discloses a soap bar holder with a tray for cleaning, the invention comprising a singular housing with a partitioned interior, a sliding tray in the bottom of the housing and a singular cover on the front of the housing. A bar soap holder and dispenser is disclosed in U.S. Pat. No. 4,630,794 to Ross, wherein the bar soap is deposited in the top of the holder, directed towards a draining tray and dispensed by pushing on the front of the holder, forcing the bar soap to an opening in the bottom of the holder and releasing the bar soap to a user's hand below. An ornamental design for an apparent multiple soap bar dispenser and holder is disclosed in U.S. Pat. No. D 359,867 to Elldrege, et al.

II. SUMMARY OF THE INVENTION

The primary objective of the invention is to provide a device to hold multiple bars, individually, and to provide a means of storage and dispensing within the device to allow easy access to the separate compartments containing different soap bars, and to provide easy replacement of the bar soap in an individual compartment which stores and provides drainage to the bar soap until further use. This is most appropriate for use with multiple designer fragrance and scented soaps or for use with different cosmetic soaps in bath or shower stalls used by several household residents.

III. DESCRIPTION OF THE DRAWINGS

The following drawings are submitted with this utility patent application.

IV. DESCRIPTION OF THE PREFERRED EMBODIMENT

Figure 1:
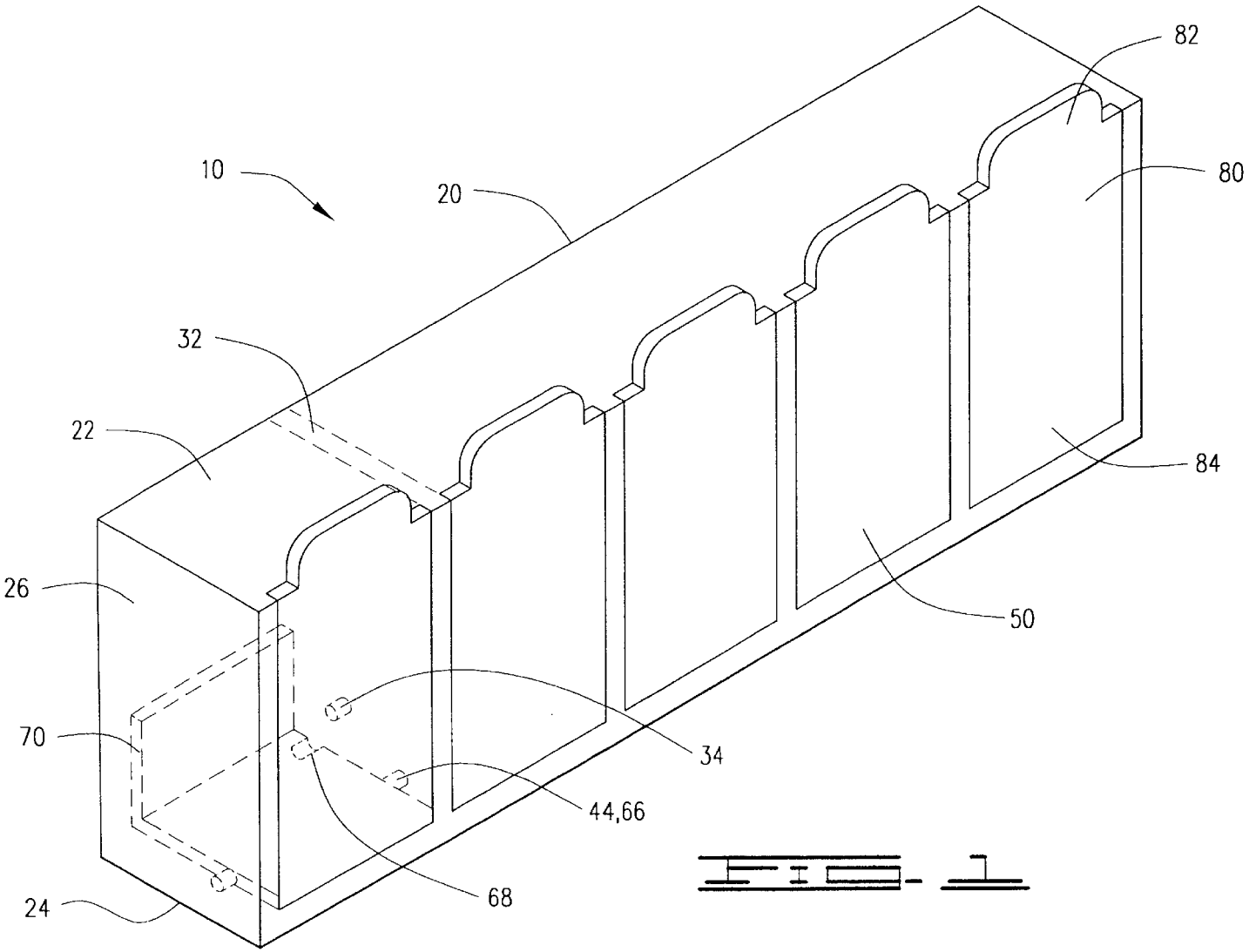
FIG. 1 is a perspective view of the invention.
Figure 2:
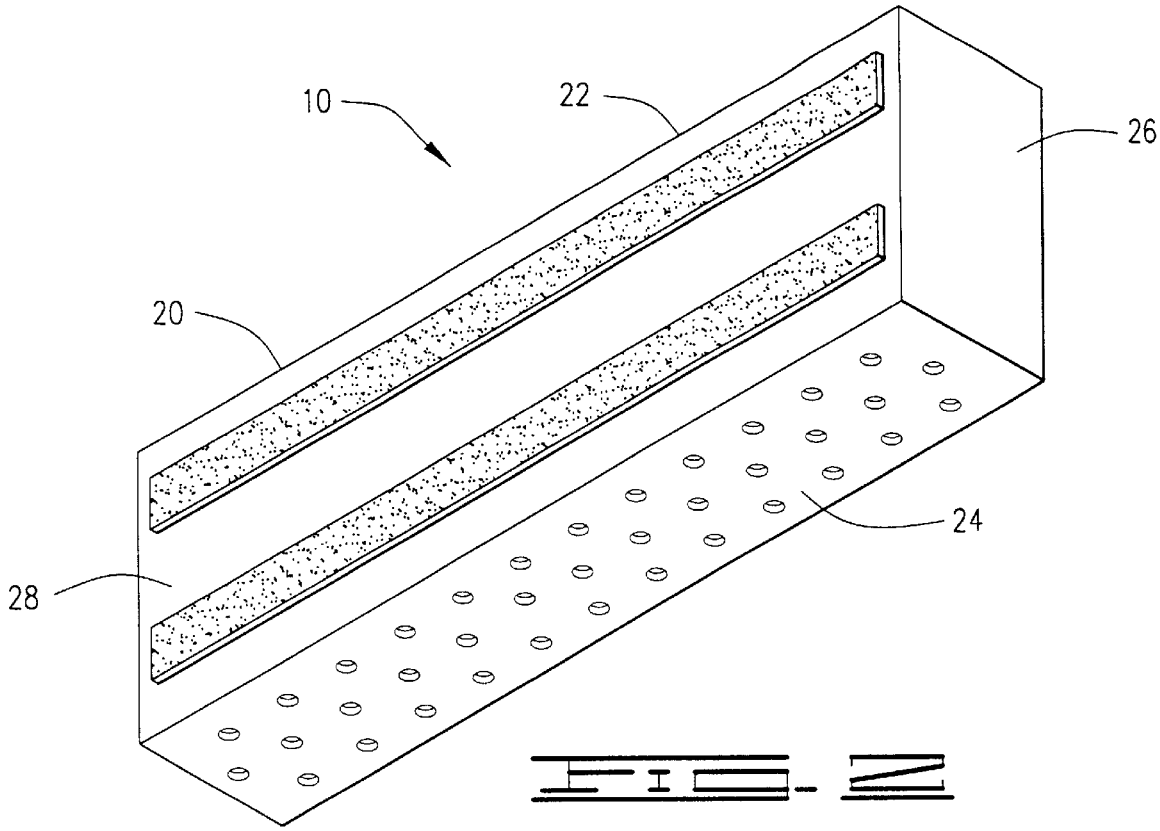
FIG. 2 is a rear and bottom perspective view of the invention.
Figure 3:
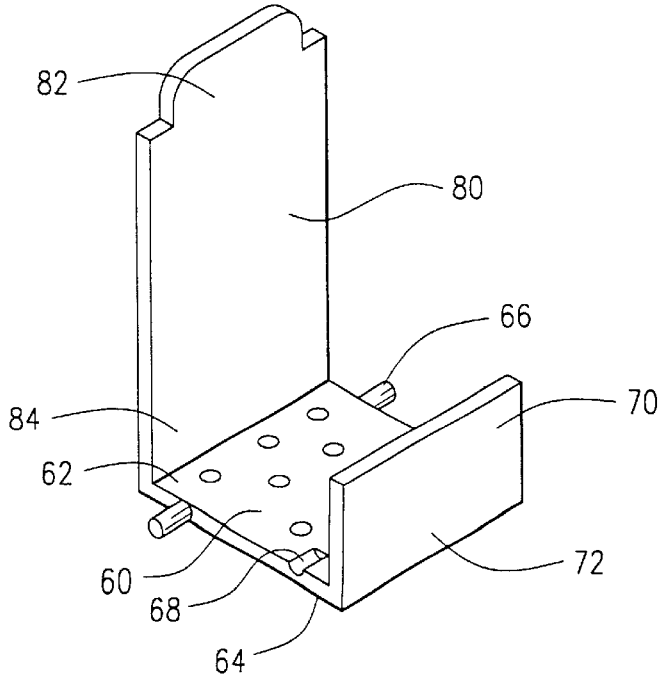
FIG. 3 is a perspective view of a pivoting drawer component.

The invention is a multiple bar soap storage dispenser 10 providing storage and drainage of multiple bar soaps 100 in the bath or shower area, the invention 10, as shown in FIGS. 1–5 of the drawings, comprising a plurality of pivoting drawers 50 and a cabinet 20 having a top segment 22, a perforated bottom segment 24, two side segments 26, and a back segment 28 which together form a box. The cabinet 20 also includes interior 30 having multiple partitions 32 dividing the interior 30 into a plurality of rectangular compartments 40. Each compartment 40 has a front opening 42 and a pair of horizontally aligned pivot holes 44 located within each compartment 40 in the partitions 32. The cabinet 20 is preferably a single molded unit made of a water proof material.

Figure 4:
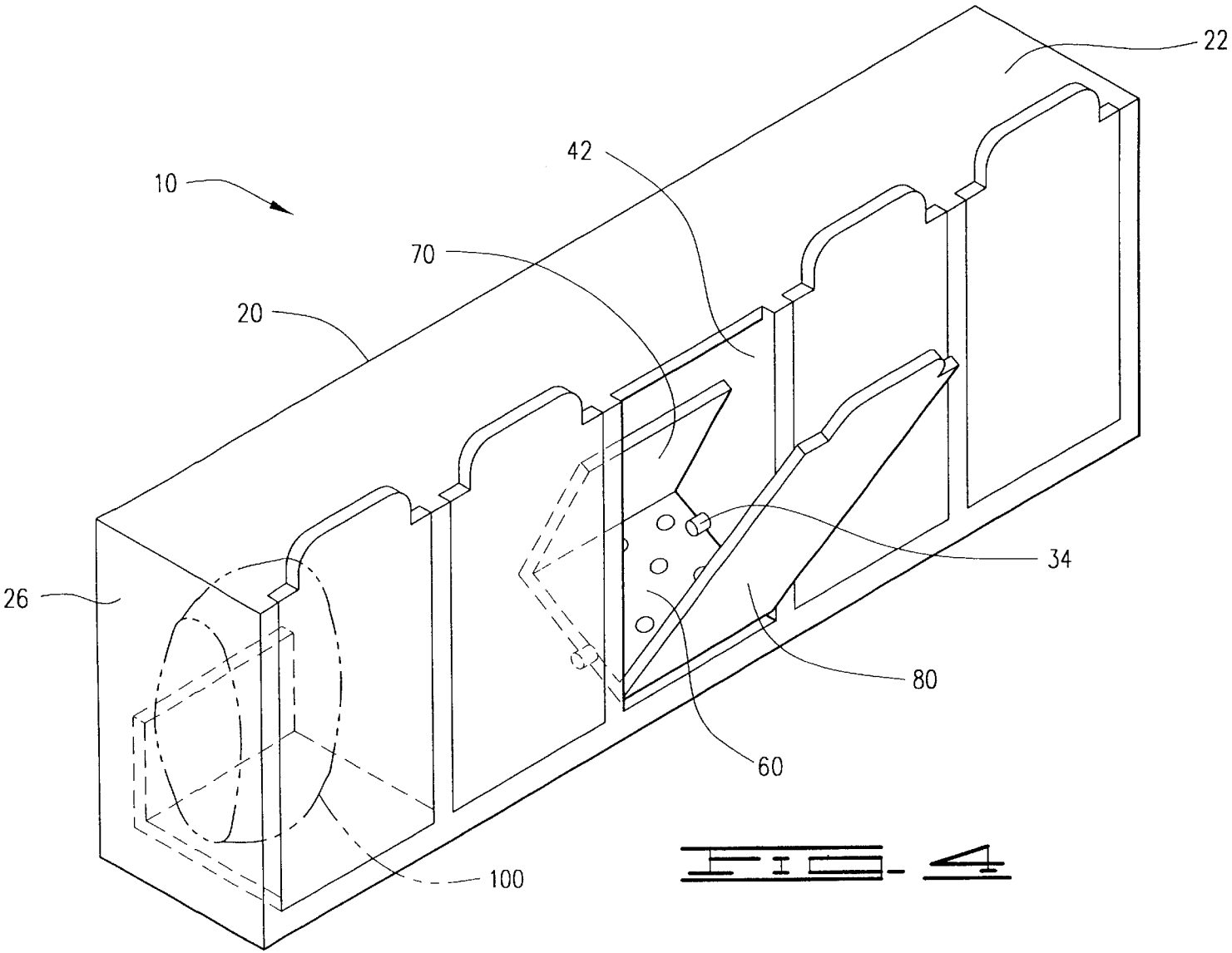
FIG. 4 is a perspective view of the invention with an open pivoting drawer component.

Each pivoting drawer 50, as shown in FIG. 4 of the drawings, is an L-shaped component having a perforated floor 60 with a front portion 62 and a rear portion 64, a rear lip 70 and a front face 80. The rear lip 70 has a lower portion 72 attached to and extending perpendicular from the rear portion 64 of the perforated floor 60. The front face 80 has an upper portion 82 and a lower portion 84, the lower portion 84 attached to and extending perpendicular from the front portion 62 of the perforated floor 60. The perforated floor 60 is the location whereupon the bar soap 100 is placed, the bar soap 100 being retained on the perforated floor 60 of the pivoting drawer 50 by the front face 80 and the rear lip 70. The front face 80 also includes an exterior surface 86. Extending from the perforated floor 60 is a pair of horizontally extending pivot pins 66. These pivot pins 66 engage the pivot holes 44 in the compartment 40, providing a pivotal attachment for each of the pivoting drawers 50 within each compartment 40. Also on each pivoting drawer 50 is a pivot stop 68 attached to the rear portion 64 of the perforated floor 60 which prevents the pivoting drawer 50 from pivoting completely open by engaging a pivot catch 34 located in the partitions 32, allowing each pivoting drawer 50 to individually pivot approximately 60 degrees from a closed position to access the contained bar soap 100 within.

When the pivoting drawers 50 are pivotally placed in each compartment 40, as shown in FIG. 5 of the drawings, the exterior surfaces 86 of the front faces 80 of the pivoting drawers 50 completely cover the front openings 42 of each of the compartments 40 with the upper portion 82 of the front face 80 extending just above the top segment 22 of the cabinet 20. Thus, a user will open the pivoting drawer 50 by pulling outward upon the upper portion 82 of the front face 80, pivoting the pivoting drawer 50 outwards from the cabinet 20 until the pivot stop 68 engages the pivot catch 34, allowing access to the bar soap 100 resting on the perforated floor 60. In a preferred embodiment, the pivot pins 66 attached to the perforated floor 60 and the pivot holes 44 in the partitions 32 are arranged in such relation as to allow each pivoting drawer 50 to remain open while empty or remain closed while empty, but causing such pivoting drawer 50 to automatically close when the bar soap 100 is placed upon the perforated floor 60 of the pivoting drawer 50, the weight of the bar soap 100 upon the perforated floor 60 causing the pivoting drawer to return to a closed position with the front face 80 being brought to an upright position. When the wet bar soap 100 is place within the pivoting drawer 50, any moisture or lather on the bar soap 100 drains through the perforated floor 60 upon which the bar soap 100 is placed and further drained from the perforated bottom 24 of the cabinet 20. The perforated floor 60 and perforated bottom 22 also provide air flow to the bar soap 100 to allow for drying of the bar soap 100 and the interior 30 of the cabinet 20 and pivoting drawer 50.

The invention 10 is to be attached to a wall in the bathroom near the bathtub, shower or sink using either adhesive tape or by permanent attachment using screws, adhesive tape or glue. The invention 10 may be provided in an opaque, colored material, or it may be provided as transparent or partially transparent to enable the user to view the bar soaps 100 within the invention 10.

While the invention has been particularly shown and described with reference to a preferred embodiment thereof, it will be understood by those skilled in the art that changes in form and detail may be made therein without departing from the spirit and scope of the invention.

What is claimed is:

1. A multiple bar soap storage dispenser providing storage and drainage of multiple bar soaps attaching to a wall within a bath or shower area, the dispenser comprising at least:

a cabinet having a perforated bottom;

a plurality of independently pivoting drawers having a perforated floor pivotally attached within the cabinet wherein each pivoting drawer may be pivotally opened allowing access to bar soaps placed within the pivoting drawers, the weight of the bar soap causing the pivoting drawer to pivot to a closed position, with the perforated bottom and perforated floor providing air flow and drainage to the bar soaps within the dispenser.

2. A multiple bar soap storage dispenser providing storage and drainage of multiple bar soaps attaching to a wall within a bath or shower area, the dispenser comprising:

a. a cabinet having a top segment, a perforated bottom segment, and two side segments forming a box, the cabinet also having an interior divided into multiple rectangular compartments by a plurality of partitions, each partition having a pivot catch and each compartment having a front opening and horizontally aligned pivot holes; and b. a plurality of L-shaped pivoting drawers having a perforated floor, a rear lip and a front face, the perforated floor having a front portion, a rear portion, horizontally emanating pivot pins and a pivot stop, a lower portion of the rear lip perpendicularly attaching to the rear portion of the perforated floor, and a lower portion of the front face perpendicularly attaching to the front portion of the perforated floor, the pivot pins of each pivoting drawer pivotally engaging the pivot holes in respective ones of the compartments, with an upper portion of the front face extending just above the top segment of the cabinet in each compartment and the pivot stop of each pivoting drawer preventing each pivoting drawer from fully opening by engaging the pivot stop in the partition.

3. The dispenser, as disclosed in claim 2, wherein the pivot stop and the pivot catch of each pivoting drawer prevent the pivoting drawer from opening beyond 60 degrees from the vertical position of the front face, and the pivot pins and the pivot holes arranged in such relation as to allow each pivoting drawer to remain open while empty or remain closed while empty, but causing such pivoting drawer to automatically close when the bar soap is placed upon the perforated floor of the pivoting drawer, the weight of the bar soap upon the perforated floor causing the pivoting drawer to return to a closed position with the front face being brought to an upright vertical position.

4. The dispenser as disclosed in claim 2, wherein the cabinet is made of a water proof material and the pivoting drawers are made of a transparent material enabling the user to view the bar soaps contained therein.

* * * * *